US008329632B2

(12) United States Patent
Mikkelsen et al.

(10) Patent No.: US 8,329,632 B2
(45) Date of Patent: Dec. 11, 2012

(54) DETERGENT COMPOSITIONS AND THE USE OF ENZYME COMBINATIONS THEREIN

(75) Inventors: Mikael Mikkelsen, Smoerum (DK); Niels Munk Ryom, Charlottenlund (DK); Claus Ladefoged, Hoersholm (DK); Sandra Friis-Jensen, Charlottenlund (DK)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 12/858,000

(22) Filed: Aug. 17, 2010

(65) Prior Publication Data

US 2010/0311636 A1 Dec. 9, 2010

Related U.S. Application Data

(63) Continuation of application No. 11/868,665, filed on Oct. 8, 2007, now abandoned.

(60) Provisional application No. 60/856,595, filed on Nov. 3, 2006.

(30) Foreign Application Priority Data

Oct. 6, 2006 (DK) ..... 2006 01307

(51) Int. Cl.
*C11D 3/386* (2006.01)

(52) U.S. Cl. ..... 510/321; 510/393

(58) Field of Classification Search ..... 510/392, 510/393, 321; 435/202, 252.3
See application file for complete search history.

(56) References Cited

U.S. PATENT DOCUMENTS

| | | | | |
|---|---|---|---|---|
| 4,537,706 | A | 8/1985 | Severson, Jr. | |
| 6,093,562 | A | 7/2000 | Bisgard-Frantzen et al. | |
| 6,632,646 | B1 * | 10/2003 | Aaslyng et al. | 435/220 |
| 2003/0180933 | A1 | 9/2003 | Hansen et al. | |
| 2005/0048611 | A1 | 3/2005 | Hoff et al. | |

FOREIGN PATENT DOCUMENTS

| | | | |
|---|---|---|---|
| GB | 1296839 | | 5/1969 |
| WO | WO 89/06279 | | 7/1989 |
| WO | WO 95/24471 | | 9/1995 |
| WO | WO 96/23873 | | 8/1996 |
| WO | WO 97/32961 | | 9/1997 |
| WO | WO 98/20115 | | 5/1998 |
| WO | WO-99/27082 | * | 6/1999 |
| WO | WO 99/27082 | A1 | 6/1999 |
| WO | WO 00/60063 | | 10/2000 |
| WO | WO 01/66712 | | 9/2001 |
| WO | WO 2006/002643 | | 1/2006 |

* cited by examiner

*Primary Examiner* — Peter D. Mulcahy
*Assistant Examiner* — Henry Hu
(74) *Attorney, Agent, or Firm* — Kristin J. McNamara

(57) ABSTRACT

New detergent compositions and the use of enzyme combinations therein are disclosed. The compositions have enhanced stability of non protease enzymes present in the compositions.

15 Claims, No Drawings

DETERGENT COMPOSITIONS AND THE USE OF ENZYME COMBINATIONS THEREIN

CROSS-REFERENCE TO RELATED APPLICATIONS

This application is a continuation of U.S. application Ser. No. 11/868,665 filed on Oct. 8, 2007 (now abandoned) which claims priority or the benefit under 35 U.S.C. 119 of Danish application no. PA 2006 01307 filed Oct. 6, 2006 and U.S. provisional application No. 60/856,595 filed Nov. 3, 2006, the contents of which are fully incorporated herein by reference.

The present invention relates to aqueous liquid or gel type detergent compositions comprising specific combinations of enzymes. The detergent compositions may further comprise a combination of boric acid or a boron compound capable of forming boric acid in the composition, a polyhydroxy compound, preferably propanediol, and relatively high level of calcium ion to stabilize a selected combination of a protease enzyme and other enzymes. The invention also relates to a process for enhancing stability of the non protease enzymes in combination of a protease enzyme with other enzymes in a liquid or gel detergent composition. The invention further relates to specific protease enzymes and their use in detergent compositions

BACKGROUND ART

Proteases have been used in detergent compositions for about 50 years and a number of such proteases have in the past 10 years been developed by protein engineering of a number of precursor proteases.

The most successful precursor protease on the market is subtilisin 309—or Savinase®. Protein engineering of Savinase was first disclosed in 1989 in WO 89/06279. Subsequently a high number of patent applications relating to protein engineering of Savinase have been filed by the applicant and other companies, such as Genencor International, Inc., Procter & Gamble, Unilever NV, etc. Also, a number of Savinase variants have been marketed by Novozymes A/S and Genencor International, Inc.

The specific Savinase variant comprising the modifications Y167A+R170S+A194P was disclosed in WO 98/20115. In the present application we designate this variant subtilisin KL.

Aqueous liquid and gel detergent compositions containing enzymes, including proteases, are well known in the art. The major problem encountered with such compositions is that of ensuring a sufficient storage stability of the enzymes in the compositions. It is particularly difficult to stabilize amylases in the presence of proteases, which can readily degrade amylases in aqueous liquid or gel detergent compositions but also other enzymes, such as lipases, cellulases, etc. are frequently degraded by the proteases.

High-alkaline amylases such as alpha amylases are described in British Specification No. 1,296,839. The use of an enzyme stabilizing system comprising a mixture of boric acid or an alkali metal borate with calcium ion, and preferably with a polyol, is disclosed in U.S. Pat. No. 4,537,706, Severson. Certain a-amylases that provide improved cleaning and stain removal are disclosed in WO97/32961, Baeck et al., and in WO 96/23873 and U.S. Pat. No. 6,093,562.

DISCLOSURE OF THE INVENTION

The present invention relates to detergent compositions comprising subtilisin KL and/or variants thereof in combination with at least one other enzyme, such as a protease, a lipase, a cutinase, an amylase, a carbohydrase; a cellulase; a pectinase; a pectate lyase; a hemicellulase, e.g. a mannanase, an arabinase, a galactanase, a xylanase; an oxidase, e.g., a laccase; and/or a peroxidase.

The amylases to be used in the detergent compositions of the invention are the amylase from *B. licheniformis* and other amylases, such as those disclosed in WO 2001/066712, WO 2006/002643, WO 2000/60060.

The cellulases to be used in the detergent compositions of the invention are such as those disclosed in WO 1995/024471, WO 91/17244, WO 2002/099091.

The lipases to be used in the detergent compositions of the invention are such as those disclosed in WO 2000/060063.

The mannanases to be used in the detergent compositions of the invention are such as those disclosed in WO 99/64619.

The endoglucanase to be used in the detergent compositions of the invention are such as those disclosed in WO 91/17244

The subtilisin KL variants of the present invention are such as those indicated in WO 98/20115 and especially those indicated in Table 1:

TABLE 1

| Mutations in subtilisin KL |
|---|
| None |
| *36D |
| P14T |
| N18K |
| N62D |
| V83L |
| A133P |
| E136Q |
| E136R |
| E136K |
| N140R |
| N140K |
| S141E |
| S141N |
| S141Y |
| S141R |
| T143R |
| T143K |
| S153R |
| S156R |
| A160R |
| S162R |
| S162K |
| I165R |
| I165K |
| Y171R |
| Y171K |
| A172R |
| A172K |
| A174R |
| N173R |
| N173K |
| A174K |
| N76D |
| Y176R |
| Y176K |
| A187R |
| A187K |
| S188P |
| S190P |
| Q191R |
| Y192R |
| Y192R |
| Q191P |
| Y192A |
| Y192P |
| D197N |
| D197R |

TABLE 1-continued

| Mutations in subtilisin KL |
|---|
| D197E |
| D197K |
| D197G |
| A228V |
| A230V |
| T260R |
| T260K |
| G264R |
| G264K |
| S265T |
| S265R |
| S265K |
| N218S |
| M222S |
| M222A |
| M222G |
| M222T |
| M222V |
| M222S |
| N243R |
| V244R |
| N248R |
| K251R |
| N252R |
| N261R |
| Combinations |
| S9R + A15T + T22A + N218S + K251R |
| S9R + A15T + T22A + V84I + N218S |
| V30I + V139L + N218S |
| V84I + V139L + N218S |
| N76D + N218S |
| N76D + A228V |
| N76D + A230V |
| N76D + N218S + A230V |
| N76D + A228V + A230V |
| N218S + R247Q |
| N218S + R247H |
| N218S + R247E |
| N218S + R247K |
| D181N + N218S |
| N218S + A230V |
| K251R + S265K |
| P14T + N18K |
| T274H + R275H + *275aH + *275bH + *275cH + *275dH = T274H + R275HHHHH |
| T274H + R275H + *275aH + *275bH + *275cH = T274H + R275HHHH |
| S87N + S101G, V104N |
| *36D + N76D + H120D + G195E + K235L |
| A133P + M222S |
| Insertions and combinations therewith |
| *96aA |
| *96aA + A98T |
| *96aA + A133P |
| *96aA + A98T + A133P |
| *96aA + A98T + N218S |
| *97aP + A98T + N218S |
| *98aT, |
| *98aT + S99N + N218S |
| G97D + *98aT + N218S |
| *99aE = S99SE |
| *99aD = S99SD |
| *99aD + M222S = S99SD + M222S |
| N76D + s99A + *99aE = N76D + S99AE |
| N76D + *99aD + A230V = N76D + S99SD + A230V |
| S99A + *99aD = S99AD |
| S99A + *99aD + M222S = S99AD + M222S |
| S99A + *99aD + N218S = S99AD + N218S |
| S99A + *99aE + A230V = S99AE + A230V |
| A228V + A230V |
| *130aL + P194A |

It has surprisingly been found that subtilisin KL and variants thereof exhibit a remarkable compatibility to other enzymes used in liquid detergent compositions such as lipases, amylases, cellulases, peroxidases/oxidases and hemicellulases. This property results in a substantial increase in the residual activity of these enzymes in combination with subtilisin KL and variants thereof as compared to the residual activity in the presence of other proteases, even after long periods of storage. In the end the result is an improved performance of the detergent composition or that similar results can be obtained with reduced amounts of enzyme Nomenclature and Conventions for Designation of Variants In describing the various subtilisin KL enzyme variants produced or contemplated according to the invention, the following nomenclatures and conventions have been adapted for ease of reference: A frame of reference is first defined by aligning the parent enzyme with subtilisin BPN' (BASBPN).

The alignment can be obtained by the GAP routine of the GCG package version 9.1 to number the variants using the following parameters: gap creation penalty=8 and gap extension penalty=8 and all other parameters kept at their default values.

Another method is to use known recognized alignments between subtilases, such as the alignment indicated in WO 91/00345. In most cases the differences will not be of any importance.

Thereby a number of deletions and insertions will be defined in relation to BASBPN. For a detailed description of the nomenclature of modifications introduced in a polypeptide by genetic manipulation we refer to WO 00/71691 page 7-12, hereby incorporated by reference.

Numbering of amino acid positions/residues If nothing else is mentioned the amino acid numbering used herein correspond to that of the subtilase BPN' (BASBPN) sequence. For further description of the BPN' sequence, see Siezen et al., Protein Engng. 4 (1991) 719-737.

"SAVINASE®" Savinase® is marketed by Novozymes A/S. It is subtilisin 309 from B. Lentus.

Modification(s) of a subtilisin KL variant. The term "modification(s)" used herein is defined to include chemical modification as well as genetic manipulation of the DNA encoding subtilisin KL. The modification(s) can be replacement(s) of the amino acid side chain(s), substitution(s), deletion(s) and/or insertions in or at the amino acid(s) of interest.

Subtilase variant. In the context of this invention, the term subtilase variant or mutated subtilase means a subtilase that has been produced by an organism which is expressing a mutant gene derived from a parent microorganism which possessed an original or parent gene and which produced a corresponding parent enzyme, the parent gene having been mutated in order to produce the mutant gene from which said mutated subtilase protease is produced when expressed in a suitable host.

Homologous subtilase sequences. The homology between two amino acid sequences is in this context described by the parameter "identity". In order to determine the degree of identity between two subtilases the GAP routine of the GCG package version 9.1 can be applied (infra) using the same settings. The output from the routine is besides the amino acid alignment the calculation of the "Percent Identity" between the two sequences. Based on this description it is routine for a person skilled in the art to identify suitable homologous subtilases, which can be modified according to the invention.

Isolated polynucleotide. The term "isolated", when applied to a polynucleotide, denotes that the polynucleotide has been removed from its natural genetic milieu and is thus free of other extraneous or unwanted coding sequences, and is in a form suitable for use within genetically engineered protein production systems. Such isolated molecules are those that are separated from their natural environment and include cDNA and genomic clones. Isolated DNA molecules of the present invention are free of other genes with which they are ordinarily associated, but may include naturally occurring 5' and 3' untranslated regions such as promoters and terminators. The identification of associated regions will be evident to one of ordinary skill in the art (see for example, Dynan and Tijan, Nature 316:774-78, 1985). The term "an isolated polynucleotide" may alternatively be termed "a cloned polynucleotide".

Isolated protein. When applied to a protein, the term "isolated" indicates that the protein has been removed from its native environment. In a preferred form, the isolated protein is substantially free of other proteins, particularly other homologous proteins (i.e. "homologous impurities" (see below)). An isolated protein is more than 10% pure, preferably more than 20% pure, more preferably more than 30% pure, as determined by SDS-PAGE. Further it is preferred to provide the protein in a highly purified form, i.e., more than 40% pure, more than 60% pure, more than 80% pure, more preferably more than 95% pure, and most preferably more than 99% pure, as determined by SDS-PAGE. The term "isolated protein" may alternatively be termed "purified protein".

Homologous impurities. The term "homologous impurities" means any impurity (e.g. another polypeptide than the subtilase of the invention), which originate from the homologous cell where the subtilase of the invention is originally obtained from.

Obtained from. The term "obtained from" as used herein in connection with a specific microbial source, means that the polynucleotide and/or subtilase produced by the specific source, or by a cell in which a gene from the source has been inserted.

Substrate. The term "substrate" used in connection with a substrate for a protease should be interpreted in its broadest form as comprising a compound containing at least one peptide (amide) bond susceptible to hydrolysis by a subtilisin protease.

Product. The term "product" used in connection with a product derived from a protease enzymatic reaction should, in the context of the present invention, be interpreted to include the products of a hydrolysis reaction involving a subtilase protease. A product may be the substrate in a subsequent hydrolysis reaction.

Wash Performance. In the present context the term "wash performance" is used as an enzyme's ability to remove proteinaceous or organic stains present on the object to be cleaned during e.g. wash or hard surface cleaning.

The detergent composition of the invention may for example be formulated as a hand or machine laundry detergent composition including a laundry additive composition suitable for pre-treatment of stained fabrics and a rinse added fabric softener composition, or be formulated as a detergent composition for use in general household hard surface cleaning operations, or be formulated for hand or machine dishwashing operations.

In a specific aspect, the invention provides a detergent additive comprising the enzyme of the invention. The detergent additive as well as the detergent composition comprises at least one other enzyme such as a protease, a lipase; a cutinase; an amylase; a carbohydrase; a cellulase; a pectinase; a pectate lyase; a hemicellulase, e.g. a mannanase, an arabinase, a galactanase, a xylanase; an oxidase, e.g., a laccase; and/or a peroxidase.

In general the properties of the chosen enzyme(s) should be compatible with the selected detergent, (i.e. pH-optimum, compatibility with other enzymatic and non-enzymatic ingredients, etc.), and the enzyme(s) should be present in effective amounts.

Lipases: Suitable lipases include those of bacterial or fungal origin. Chemically modified or protein engineered mutants are included. Examples of useful lipases include lipases from *Humicola* (synonym *Thermomyces*), e.g. from *H. insolens* as described in WO 96/13580, a *Pseudomonas lipase*, e.g. from *Pseudomonas* sp. strain SD 705 (WO 95/06720 and WO 96/27002), *P. wisconsinensis* (WO 96/12012), or a *Bacillus lipase* as disclosed in WO 2000/060063.

Other examples are lipase variants such as those described in WO 92/05249, WO 94/01541, EP 407225, EP 260105, WO 95/35381, WO 96/00292, WO 95/30744, WO 94/25578, WO 95/14783, WO 95/22615, WO 97/04079 and WO 97/07202. Preferred commercially used lipase enzymes include Lipolase®, Lipolase Ultra® and Lipex® (Novozymes A/S).

Amylases: Suitable amylases (α and/or β) include those of bacterial or fungal origin. Chemically modified or protein engineered mutants are included. Amylases include, for example, α-amylases obtained from *Bacillus*. Examples of useful amylases are the variants described in WO 94/02597, WO 94/18314, WO 96/23873, WO 2000/60060, and WO 97/43424, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444. Commercially used amylases are Duramyl®, Termamyl®, Stainzyme®, Stainzyme Plus®, Stainzyme Ultra®, Fungamyl® and BAN® (Novozymes A/S), Rapidase™, Purastar™ and Purastar OxAm™ (from Genencor International Inc.).

Cellulases: Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Myceliophthora thermophila* and *Fusarium oxysporum* disclosed in U.S. Pat. No. 5,648,263, U.S. Pat. No. 5,691,178, U.S. Pat. No. 5,776,757 and WO 89/09259. Especially suitable cellulases are the alkaline or neutral cellulases having colour care and whiteness maintenance benefits. Examples of such cellulases are cellulases described in EP 0 531 372, WO 96/11262, WO 96/29397, WO 98/08940. Other examples are cellulase variants such as those described in WO 94/07998, EP 0 531 315, U.S. Pat. No. 5,457,046, U.S. Pat. No. 5,686,593, U.S. Pat. No. 5,763,254, WO 95/24471, WO 98/12307 and PCT/DK98/00299. Commercially used cellulases include Renozyme®, Celluzyme®, Celluclean®, Endolase® and Carezyme® (Novozymes A/S), Clazinase™, and Puradax HA™ (Genencor Int. Inc.), and KAC-500(B)™ (Kao Corporation).

Peroxidases/Oxidases: Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Commercially used peroxidases include Guardzyme™ (Novozymes A/S).

Hemicellulases: Suitable hemicellulases include those of bacterial or fungal origin. Chemically modified or protein engineered mutants are included. Suitable hemicellulases include mannanase, lichenase, xylanase, arabinase, galactanase, acetyl xylan esterase, glucorunidase, ferulic acid esterase, coumaric acid esterase and arabinofuranosidase as described in WO 95/35362. Suitable mannanases are described in WO 99/64619. Commercially used hemicellulases include Mannaway® (Novozymes A/S).

The detergent enzyme(s) may be included in a detergent composition by adding separate additives containing one or more enzymes, or by adding a combined additive comprising all of these enzymes. A detergent additive of the invention, i.e. a separate additive or a combined additive, can be formulated e.g. as a gel, a liquid, a slurry, etc. Preferred detergent additive formulations are liquids, in particular stabilized liquids, or slurries.

Liquid enzyme preparations may, for instance, be stabilized by adding a polyol such as propylene glycol, a sugar or sugar alcohol, lactic acid or boric acid according to established methods. Protected enzymes may be prepared according to the method disclosed in EP 238,216.

The detergent composition of the invention may be in any convenient form, e.g. a paste, a gel or a liquid. A liquid detergent may be aqueous, typically containing up to 70% water and 0-30% organic solvent, or non-aqueous.

The detergent composition comprises one or more surfactants, which may be non-ionic including semi-polar and/or anionic and/or cationic and/or zwitterionic. The surfactants are typically present at a level of from 0.1% to 60% by weight.

When included therein the detergent will usually contain from about 1% to about 40% of an anionic surfactant such as linear alkylbenzenesulfonate, alpha-olefinsulfonate, alkyl sulfate (fatty alcohol sulfate), alcohol ethoxysulfate, secondary alkanesulfonate, alpha-sulfo fatty acid methyl ester, alkyl- or alkenylsuccinic acid or soap.

When included therein the detergent will usually contain from about 0.2% to about 40% of a non-ionic surfactant such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

The detergent may contain 0-65% of a detergent builder or complexing agent such as zeolite, diphosphate, triphosphate, phosphonate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g. SKS-6 from Hoechst).

The detergent may comprise one or more polymers. Examples are carboxymethyl-cellulose, poly(vinylpyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid copolymers.

The detergent may contain a bleaching system which may comprise a H2O2 source such as perborate or percarbonate which may be combined with a peracid-forming bleach activator such as tetraacetylethylenediamine or nonanoyloxybenzenesulfonate. Alternatively, the bleaching system may comprise peroxyacids of e.g. the amide, imide, or sulfone type.

The enzyme(s) of the detergent composition of the invention may be stabilized using conventional stabilizing agents, e.g., a polyol such as propylene glycol, diethylene glycol, methylpropanediol, or glycerol, a sugar or sugar alcohol, lactic acid, boric acid, or a boric acid derivative, e.g., an aromatic borate ester, or a phenyl boronic acid derivative such as 4-formylphenyl boronic acid or mono- or triethanolamine, and the composition may be formulated as described in e.g. WO 92/19709, WO 92/19708, U.S. Pat. No. 5,972,873 or EP 0832174.

The detergent may also contain other conventional detergent ingredients such as e.g. fabric conditioners including clays, foam boosters, suds suppressors, anti-corrosion agents, soil-suspending agents, anti-soil redeposition agents, dyes, bactericides, optical brighteners, hydrotropes, tarnish inhibitors, or perfumes.

It is at present contemplated that in the detergent compositions any enzyme, in particular the enzyme of the invention, may be added in an amount corresponding to 0.01-100 mg of enzyme protein per litre of wash liquor, preferably 0.05-5 mg of enzyme protein per litre of wash liquor, in particular 0.1-1 mg of enzyme protein per litre of wash liquor.

Variations in local and regional conditions, such as water hardness and wash temperature calls for regional detergent compositions. Detergent Examples 1 provide ranges for the composition of a liquid detergent.

Materials and Methods

Enzymes

In the examples below the following commercial available enzymes are used. Alcalase® and Savinase® are used as standards for comparison:

| Name | Enzyme type | Derived from or disclosed in |
|---|---|---|
| Alcalase ® | Protease, subtilisin Carlsberg | *B. licheniformis* |
| Savinase ® | Protease, subtilisin 309 | *B. lentus* |
| Termamyl ® Novozym 342 ® | amylase | *B. licheniformis* *H. Insolens* |
| Amylase A | amylase | The amylase variant D183* + G184* + R118K + N195F + R458K. WO 01/66712 |
| Mannan A | Mannanase | WO 99/64619 |
| Lipase A | Lipase | T231R + N233R variant of *T. lanoginosus* lipase, WO 00/60063 |
| Cellulase A | Cellulase | *H. Insolens*, WO 91/17244 |

Also the protease designated subtilisin KL and variants thereof are used.

Subtilisin KL is a Y167A+R170S+A194P variant of Savinase (using BPN' numbering)

Assays

Protease Compatibility:

The protease compatibility of the enzymes is determined by preparing the detergent compositions as indicated in each Example and measuring the residual activity of the other enzyme activities after the periods indicated in the Examples.

Enzyme Activity:

Enzyme activities are measured using well known recognized standard methods.

Detergent Compositions

The detergent compositions used in the examples are either a model detergent according to the compositions provided below or commercial liquid laundry detergents e.g. Tide, Era, Gain, Cheer, Wisk, All, Purex, Arm & Hammer, Sun, Great Value, Ariel, Persil, Total, Skip, Dash, Dixan, Ava or any other brand extension or concentrated versions for the liquid detergent. If the commercial laundry detergent used comprises enzymes these are inactivated prior to use by heating the detergent in a microwave oven at 85° C. for 5 minutes.

Model detergent composition A—Detergent Example 1

| Group | Subname | Content |
|---|---|---|
| Surfactants | | 5-60% |
| | Sulphonates | 0-30% |
| | Sulphates | 0-15% |
| | Soaps | 0-15% |
| | Non-ionics | 0-15% |
| | Cationics | 0-15% |
| | Amine oxides | 0-10% |
| | FAGA | 0-10% |
| Solvents | | 5-35% |
| | Ethanol | 0-10% |
| | MPG—monopropylene glycol | 0-20% |
| | DEG—Diethylene glycol | 0-15% |
| | MPD—methylpropanediol | 0-15% |
| | MEA—Monoethanolamine | 0-10% |
| | TEA—Triethanolamine | 0-10% |
| | Hydrotropes like SXS, SCS, etc | |
| | Sodium Cumene Sulfonate | 0-10% |
| | Sodium Xylene Sulfonates | |
| | Other solvents | 0-10% |
| Builders | | 0-20% |
| | NaCitrate | 0-15% |
| | Other builders | 0-15% |
| Others | | 0-20% |
| | Polymers | 0-5% |
| | Enzymes | 0-10% |
| | Boric acid and derivatives thereof | 0-5% |
| | Foam Regulators | 0-10% |
| | Others | 0-10% |

Water is added to the balance of 100%

EXAMPLE 1

A commercial liquid detergent for laundry was added commercial proteases, amylases, Lipase, and cellulases as listed below (if the detergent already contains enzymes then these can be inactivated by heating the detergent in a microwave oven up to 85° C. for 5 minutes). When Subtilisin KL was used in comparison with commercial protease, same amount of activity units was used.

The stability of the enzymes as determined by % residual enzyme activity after storage at 20° C. for 1, 2 and 4 weeks is shown in table 2-5.

Storage conditions: 20° C. for 1, 2, 4 weeks in closed glass vessels

TABLE 2

| Residual amylase activity | | | | |
|---|---|---|---|---|
| Weeks | 1 | 2 | 3 | 4 |
| 0.5% Alcalase Ultra 2.5 L<br>0.3% Termamyl 300 L | 93 | 92 | 89 | 87 |
| Subtilisin KL<br>0.3% Termamyl 300 L | 96 | 98 | 95 | 92 |
| 0.5% Alcalase Ultra 2.5 L<br>0.3% Amylase A 12 L | 34 | 16 | 10 | 7 |
| Subtilisin KL<br>0.3% Amylase A 12 L | 90 | 86 | 82 | 78 |

TABLE 3

| Residual lipase activity | | | | |
|---|---|---|---|---|
| Weeks | 1 | 2 | 3 | 4 |
| 0.5% Alcalase Ultra 2.5 L<br>0.3% Lipase A 100 L | 12 | 11 | 8 | 9 |
| Subtilisin KL<br>0.3% Lipase A 100 L | 72 | 54 | 46 | 38 |

TABLE 4

| Residual cellulase activity | | | | |
|---|---|---|---|---|
| Weeks | 1 | 2 | 3 | 4 |
| 0.5% Alcalase Ultra 2.5 L<br>0.3% Cellulase A 5000 L | | 85 | 76 | 68 |
| Subtilisin KL<br>0.3% Cellulase A 5000 L | | 99 | 87 | 88 |

TABLE 5

| Residual protease activity | | | | |
|---|---|---|---|---|
| Weeks | 1 | 2 | 3 | 4 |
| 0.5% Alcalase Ultra 2.5 L<br>0.3% Cellulase A 5000 L | 86 | 64 | 57 | 50 |
| Subtilisin KL<br>0.3% Cellulase A 5000 L | 84 | 74 | 65 | 56 |

As can be seen above the enzyme compatibility of the present invention is clearly improved when Subtilisin KL is selected as the protease instead of Alcalase 2.5L. The enzyme stability of Cellulase A 5000L, Lipase A 100L, Termamyl 300L and Amylase A 12L after 1, 2, 3 and 4 weeks at 30° C. is clearly improved if Subtilisin KL is the protease. The Subtilisin KL protease is just as stable as the reference protease, Alcalase 2.5L, used.

EXAMPLE 2

The commercial liquid detergent for laundry of Example 1 was added commercial proteases, amylases, Lipase, and cellulases as listed below (if the detergent already contains enzymes then these are inactivated by heating the detergent in a micro oven up to 85° C. for 5 minutes). When Subtilisin KL was used in comparison with commercial protease, same amount of activity units was used.

The stability of the enzymes as determined by % residual enzyme activity after storage at 30° C. for 1, 2 and 4 weeks in shown in table 6-9.

TABLE 6

| Residual amylase activity | | | | |
|---|---|---|---|---|
| Weeks | 1 | 2 | 3 | 4 |
| 0.5% Alcalase Ultra 2.5 L<br>0.3% Termamyl 300 L | 85 | 78 | 71 | 66 |
| Subtilisin KL<br>0.3% Termamyl 300 L | 93 | 87 | 83 | 73 |
| 0.5% Alcalase Ultra 2.5 L<br>0.3% Amylase A 12 L | 10 | 5 | 4 | 4 |
| Subtilisin KL<br>0.3% Amylase A 12 L | 81 | 74 | 63 | 59 |

TABLE 7

| Residual lipase activity | | | | |
|---|---|---|---|---|
| Weeks | 1 | 2 | 3 | 4 |
| 0.5% Alcalase Ultra 2.5 L<br>0.3% Lipase A 100 L | 9 | 8 | 5 | 6 |
| Subtilisin KL<br>0.3% Lipase A 100 L | 35 | 17 | 11 | 6 |

TABLE 8

| Residual cellulase activity | | | | |
|---|---|---|---|---|
| Weeks | 1 | 2 | 3 | 4 |
| 0.5% Alcalase Ultra 2.5 L<br>0.3% Cellulase A 5000 L | 47 | 24 | 16 | 13 |
| Subtilisin KL<br>0.3% Cellulase A 5000 L | 67 | 66 | 55 | 55 |

TABLE 9

| Residual protease activity | | | | |
|---|---|---|---|---|
| Weeks | 1 | 2 | 3 | 4 |
| 0.5% Alcalase Ultra 2.5 L | 57 | 36 | 29 | 21 |
| Subtilisin KL | 55 | 36 | 24 | 16 |

As can be seen above the enzyme compatibility of the present invention is clearly improved when Subtilisin KL is selected as the protease instead of Alcalase 2.5L. The enzyme stability of Cellulase A 5000L, Lipase A 100L, Termamyl 300L and Amylase A 12L after 1, 2, 3 and 4 weeks at 30° C. is clearly improved if Subtilisin KL is selected as protease. The Subtilisin KL protease is just as stable as the reference protease, Alcalase 2.5L, used.

EXAMPLE 3

A commercial liquid detergent for laundry was added commercial proteases, amylases, and lipases as listed below (if the detergent already contains enzymes then these can be inactivated by heating the detergent in a micro oven up to 85° C. for 5 minutes). When Subtilisin KL was used in comparison with commercial protease, same amount of activity units was used.

The stability of the enzymes as determined by % residual enzyme activity after storage at 30° C. for 1, 2, 4 and 8 weeks is shown in table 10-11.

TABLE 10

| Residual amylase activity | | | | |
|---|---|---|---|---|
| Weeks | 1 | 2 | 4 | 8 |
| 0.4% Alcalase 2.5 L<br>0.4% Amylase A 12 L | 42 | 36 | 19 | 9 |
| 0.4% Savinase 16 L<br>0.4% Amylase A 12 L | 48 | 41 | 24 | 9 |
| Subtilisin KL<br>0.4% Amylase A | 77 | 73 | 63 | 42 |
| 0.4% Amylase A 12 L<br>(without protease) | 88 | 89 | 82 | 62 |

TABLE 11

| Residual lipase activity | | |
|---|---|---|
| | Weeks | |
| | 1 | 2 |
| 0.4% Alcalase 2.5 L<br>0.4% Lipase A 100 L | 9 | 8 |
| Subtilisin KL<br>0.4% Lipase A 100 L | 33 | 22 |
| 0.4% Lipase A 100 L<br>(without protease) | 86 | 81 |

As can be seen above the enzyme compatibility of the present invention is clearly improved when Subtilisin KL is selected as the protease instead of Savinase 16L and Alcalase 2.5L. The enzyme stability of Lipase A 100L and Amylase A 12L after 2 and 8 weeks is improved significantly if Subtilisin KL is selected as the preferred protease.

EXAMPLE 4

A liquid detergent with the following formulation as shown in table 13 is prepared.

TABLE 13

| Detergent formulation | |
|---|---|
| Subname | Content |
| Calcium Chloride | 0.1% |
| LAS-Sodium Salt | 11.81% |
| Soya sebacic acid - sodium salt | 5.94% |
| Propyleneglycol | 5.05% |
| C-13-Oxoalcohol ethoxylat, 8EO | 9.45% |
| Phosphonate | 1.00% |
| Coconut sebacic acid - Triethanolamine salt | 6.50% |
| Sodium citrate | 1.00% |
| Ethanol | 4.63% |
| Opacifier | 0.12% |
| Perfume | 0.35% |
| Colour | — |
| Water to 100% | |

Enzymes Used
Protease: Savinase 16L
Alcalase 2.5L
Subtilisin KL
Subtilisin KL M222S
Subtilisin KL *36D
Subtilisin KL N76D+S99SE+A230V
Subtilisin KL S162R
Subtilisin KL S99SE+N76D
Subtilisin KL N76D
Subtilisin KL A228V
Subtilisin KL A230V
Subtilisin KL A228V+A230V
Lipase: Lipase A 100L
Amylase: Termamyl 300L
Mannase: Mannan A 4.0L
Test Set-Up I
Addition of enzymes: I) Savinase 16L (0.17 mg EP/g)
II) Subtilisin KL (0.17 mg EP/g)
III) Alcalase 2.5L (0.17 mg EP/g)
Amylase: Termamyl 300L (0.4%)
The amounts of protease are given in enzyme protein (active) per grammes [EP/g].

The detergent formulations are stored in 2, and 4 weeks at 30° C. in closed glass vessels. After storage the residual protease and amylase activities are determined.

TABLE 14

| % Residual Protease activity | Weeks 2 | Weeks 4 |
|---|---|---|
| 0.17 mg Savinase 16L + 0.4% Termamyl 300L | 21 | 15 |
| 0.17 mg Alcalase 2.5L + 0.4% Termamyl 300L | 23 | 16 |
| 0.17 mg Subtilisin KL + 0.4% Termamyl 300L | 16 | 10 |

TABLE 15

| % Residual Amylase activity | Weeks 2 | Weeks 4 |
|---|---|---|
| 0.17 mg Savinase 16L + 0.4% Termamyl 300L | 90 | 92 |
| 0.17 mg Alcalase 2.5L + 0.4% Termamyl 300L | 94 | 95 |
| 0.17 mg Subtilisin KL + 0.4% Termamyl 300L | 97 | 97 |

Test Set-Up II

Addition of enzymes: I) Savinase 16L (0.07 mg EP/g)

II) Subtilisin KL (0.07 mg EP/g)

III) Alcalase 2.5L (0.07 mg EP/g)

IV Subtilisin 2.5KL M222S (0.07 mg EP/g)

V) Subtilisin 2.5KL *36D (0.07 mg EP/g)

VI) Subtilisin KL N76D+S99SE, A230V

Lipase: Lipase A 100L (0.2%)

Amylase: Termamyl 300L (0.2%)

Mannase: Mannan A 4.0L (0.2%)

The detergent formulations are stored in 2, and 4 weeks at 30° C. in closed glass vessels. After storage the residual protease, lipase (Lip.), mannase (Man.) and amylase (Ter.) activities are determined.

TABLE 16

| % Residual Protease activity | Weeks 2 | Weeks 4 |
|---|---|---|
| 0.07 mg Savinase 16L 0.2% Ter., 0.2% Lip. and 0.2% Man. | 21 | 13 |
| 0.07 mg Alcalase 2.5L 0.2% Ter., 0.2% Lip. and 0.2% Man. | 24 | 22 |
| 0.07 mg Subtilisin KL 0.2% Ter., 0.2% Lip. and 0.2% Man. | 18 | 13 |
| 0.07 mg Subtilisin KL M222S 0.2% Ter., 0.2% Lip. and 0.2% Man. | 50 | 50 |
| 0.07 mg Subtilisin KL *36D 0.2% Ter., 0.2% Lip. and 0.2% Man. | 59 | 19 |
| 0.07 mg Subtilisin KL N76D + S99SE + A230V 0.2% Ter., 0.2% Lip. and 0.2% Man. | 84 | 77 |

TABLE 17

| % Residual Amylase activity | Weeks 2 | Weeks 4 |
|---|---|---|
| 0.07 mg Savinase 16L 0.2% Ter., 0.2% Lip. and 0.2% Man. | 97 | 96 |
| 0.07 mg Alcalase 2.5L 0.2% Ter., 0.2% Lip. and 0.2% Man. | 87 | 89 |
| 0.07 mg Subtilisin KL 0.2% Ter., 0.2% Lip. and 0.2% Man. | 97 | 97 |
| 0.07 mg Subtilisin KL M222S 0.2% Ter., 0.2% Lip. and 0.2% Man. | 98 | 101 |
| 0.07 mg Subtilisin KL *36D 0.2% Ter., 0.2% Lip. and 0.2% Man. | 97 | 98 |
| 0.07 mg Subtilisin KL N76D + S99SE + A230V 0.2% Ter., 0.2% Lip. and 0.2% Man. | 98 | 98 |

TABLE 18

| % Residual Lipase activity | Weeks 2 | Weeks 4 |
|---|---|---|
| 0.07 mg Savinase 16L 0.2% Ter., 0.2% Lip. and 0.2% Man. | 5 | 5 |
| 0.07 mg Alcalase 2.5L 0.2% Ter., 0.2% Lip. and 0.2% Man. | 5 | 5 |
| 0.07 mg Subtilisin KL 0.2% Ter., 0.2% Lip. and 0.2% Man. | 4 | 4 |
| 0.07 mg Subtilisin KL M222S 0.2% Ter., 0.2% Lip. and 0.2% Man. | 20 | 15 |
| 0.07 mg Subtilisin KL *36D 0.2% Ter., 0.2% Lip. and 0.2% Man. | 6 | 6 |
| 0.07 mg Subtilisin KL N76D + S99SE + A230V 0.2% Ter., 0.2% Lip. and 0.2% Man. | 22 | 17 |

TABLE 19

| % Residual Mannase activity | Weeks 2 | Weeks 4 |
|---|---|---|
| 0.07 mg Savinase 16L 0.2% Ter., 0.2% Lip. and 0.2% Man. | 38 | 25 |
| 0.07 mg Alcalase 2.5L 0.2% Ter., 0.2% Lip. and 0.2% Man. | 14 | 13 |
| 0.07 mg Subtilisin KL 0.2% Ter., 0.2% Lip. and 0.2% Man. | 62 | 48 |
| 0.07 mg Subtilisin KL M222S 0.2% Ter., 0.2% Lip. and 0.2% Man. | 89 | 84 |
| 0.07 mg Subtilisin KL *36D 0.2% Ter., 0.2% Lip. and 0.2% Man. | 63 | 54 |
| 0.07 mg Subtilisin KL N76D + S99SE + A230V 0.2% Ter., 0.2% Lip. and 0.2% Man. | 99 | 95 |

Test Set-Up III

Addition of enzymes: I) Savinase 16L (0.05 mg EP/g det.)

II) Subtilisin KL (0.05 mg EP/g det.)

III) Alcalase 2.5L (0.05 mg EP/g det.)

VII) Subtilisin 2.5KL S162R (0.05 mg EP/g det.)

VIII) Subtilisin KL S99SE+N76D (0.05 mg EP/g det.)

IX) Subtilisin KL N76D (0.05 mg EP/g det.)

X) Subtilisin KL A228V (0.05 mg EP/g det.)

XI) Subtilisin KL A230V (0.05 mg EP/g det.)

XII) Subtilisin KL A228V, A230V (0.05 mg EP/g det.)

EP≡E Enzyme Protein det≡E detergent

Lipase: Lipase A 100L (0.2%)

Amylase: Termamyl 300L (0.2%)

Mannase: Mannan A 4.0L (0.2%)

The detergent formulations are stored in 1, 2 and 3 weeks at 30° C. in closed glass vessels. After storage the residual protease, lipase (Lip.), mannase (Man.) and amylase (Ter.) activities are determined.

TABLE 20

% Residual Protease activity

| | Weeks | | |
|---|---|---|---|
| | 1 | 2 | 3 |
| 0.05 mg Savinase 16L 0.2% Ter., 0.2% Lip. and 0.2% Man. | 89 | 20 | 12 |
| 0.05 mg Alcalase 2.5L 0.2% Ter., 0.2% Lip. and 0.2% Man. | 85 | 37 | 37 |
| 0.05 mg Subtilisin KL 0.2% Ter., 0.2% Lip. and 0.2% Man. | 70 | 17 | 17 |
| 0.05 mg Subtilisin KL S162R 0.2% Ter., 0.2% Lip. and 0.2% Man. | 45 | 12 | 12 |
| 0.05 mg Subtilisin KL S99SE + N76D 0.2% Ter., 0.2% Lip. and 0.2% Man. | 100 | 75 | 77 |
| 0.05 mg Subtilisin KL N76D 0.2% Ter., 0.2% Lip. and 0.2% Man. | 94 | 95 | 89 |
| 0.05 mg Subtilisin KL A228V 0.2% Ter., 0.2% Lip. and 0.2% Man. | 85 | 83 | 78 |
| 0.05 mg Subtilisin KL A230V 0.2% Ter., 0.2% Lip. and 0.2% Man. | 99 | 87 | 80 |
| 0.05 mg Subtilisin KL A228V + A230V 0.2% Ter., 0.2% Lip. and 0.2% Man. | 100 | 98 | 89 |

TABLE 21

% Residual Amylase activity

| | Weeks | | |
|---|---|---|---|
| | 1 | 2 | 3 |
| 0.05 mg Savinase 16L 0.2% Ter., 0.2% Lip. and 0.2% Man. | 100 | 98 | 96 |
| 0.05 mg Alcalase 2.5L 0.2% Ter., 0.2% Lip. and 0.2% Man. | 100 | 96 | 97 |
| 0.05 mg Subtilisin KL 0.2% Ter., 0.2% Lip. and 0.2% Man. | 100 | 98 | 97 |
| 0.05 mg Subtilisin KL S162R 0.2% Ter., 0.2% Lip. and 0.2% Man. | 99 | 97 | 97 |
| 0.05 mg Subtilisin KL S99SE + N76D 0.2% Ter., 0.2% Lip. and 0.2% Man. | 99 | 98 | 98 |
| 0.05 mg Subtilisin KL N76D 0.2% Ter., 0.2% Lip. and 0.2% Man. | 100 | 100 | 100 |
| 0.05 mg Subtilisin KL A228V 0.2% Ter., 0.2% Lip. and 0.2% Man. | 100 | 100 | 100 |
| 0.05 mg Subtilisin KL A230V 0.2% Ter., 0.2% Lip. and 0.2% Man. | 100 | 100 | 100 |
| 0.05 mg Subtilisin KL A228V + A230V 0.2% Ter., 0.2% Lip. and 0.2% Man. | 100 | 100 | 100 |

TABLE 22

% Residual Lipase activity

| | Weeks | | |
|---|---|---|---|
| | 1 | 2 | 3 |
| 0.05 mg Savinase 16L 0.2% Ter., 0.2% Lip. and 0.2% Man. | 30 | 5 | 5 |
| 0.05 mg Alcalase 2.5L 0.2% Ter., 0.2% Lip. and 0.2% Man. | 10 | 6 | 6 |
| 0.05 mg Subtilisin KL 0.2% Ter., 0.2% Lip. and 0.2% Man. | 59 | 8 | 5 |

TABLE 22-continued

% Residual Lipase activity

| | Weeks | | |
|---|---|---|---|
| | 1 | 2 | 3 |
| 0.05 mg Subtilisin KL S162R 0.2% Ter., 0.2% Lip. and 0.2% Man. | 82 | 14 | 6 |
| 0.05 mg Subtilisin KL S99SE + N76D 0.2% Ter., 0.2% Lip. and 0.2% Man. | 81 | 15 | 20 |
| 0.05 mg Subtilisin KL N76D 0.2% Ter., 0.2% Lip. and 0.2% Man. | 49 | 49 | 57 |
| 0.05 mg Subtilisin KL A228V 0.2% Ter., 0.2% Lip. and 0.2% Man. | 53 | 52 | 47 |
| 0.05 mg Subtilisin KL A230V 0.2% Ter., 0.2% Lip. and 0.2% Man. | 65 | 59 | 52 |
| 0.05 mg Subtilisin KL A228V + A230V 0.2% Ter., 0.2% Lip. and 0.2% Man. | 61 | 55 | 48 |

TABLE 23

% Residual Mannase activity

| | Weeks | | |
|---|---|---|---|
| | 1 | 2 | 3 |
| 0.05 mg Savinase 16L 0.2% Ter., 0.2% Lip. and 0.2% Man. | 93 | 44 | 27 |
| 0.05 mg Alcalase 2.5L 0.2% Ter., 0.2% Lip. and 0.2% Man. | 81 | 29 | 24 |
| 0.05 mg Subtilisin KL 0.2% Ter., 0.2% Lip. and 0.2% Man. | 98 | 71 | 58 |
| 0.05 mg Subtilisin KL S162R 0.2% Ter., 0.2% Lip. and 0.2% Man. | 105 | 77 | 73 |
| 0.05 mg Subtilisin KL S99SE + N76D 0.2% Ter., 0.2% Lip. and 0.2% Man. | 98 | 98 | 100 |
| 0.05 mg Subtilisin KL N76D 0.2% Ter., 0.2% Lip. and 0.2% Man. | 89 | 96 | 90 |
| 0.05 mg Subtilisin KL A228V 0.2% Ter., 0.2% Lip. and 0.2% Man. | 95 | 96 | 92 |
| 0.05 mg Subtilisin KL A230V 0.2% Ter., 0.2% Lip. and 0.2% Man. | 107 | 90 | 89 |
| 0.05 mg Subtilisin KL A228V + A230V 0.2% Ter., 0.2% Lip. and 0.2% Man. | 97 | 88 | 84 |

The invention claimed is:

1. A detergent composition comprising a variant of a subtilisin KL in combination with at least one other enzyme selected from the group consisting of protease, lipase, cutinase, amylase, carbohydrase, cellulase, pectinase, pectate lyase, hemicellulase, oxidase, or a combination thereof, and wherein the variant of a subtilisin KL further comprises a mutation:

*36D;
P14T;
N18K;
N62D;
V83L;
A133P;
E136Q;
E136R;
E136K;
N140R;
N140K;
S141E;
S141N;
S141Y;
S141R;
T143R;

-continued

T143K;
S153R;
S156R;
A160R;
S162R;
S162K;
I165R;
I165K;
Y171R;
Y171K;
A172R;
A172K;
A174R;
N173R;
N173K;
A174K;
N76D;
Y176R;
Y176K;
A187R;
A187K;
S188P;
S190P;
Q191R;
Y192R;
Y192R;
Q191P;
Y192A;
Y192P;
D197N;
D197R;
D197E;
D197K;
D197G;
A228V;
A230V;
T260R;
T260K;
G264R;
G264K;
S265T;
S265R;
S265K;
N218S;
M222S;
M222A;
M222G;
M222T;
M222V;
M222S;
N243R;
V244R;
N248R;
K251R;
N252R;
N261R;
S9R + A15T + T22A + N218S + K251R;
S9R + A15T + T22A + V84I + N218S;
V30I + V139L + N218S;
V84I + V139L + N218S;
N76D + N218S;
N76D + A228V;
N76D + A230V;
N76D + N218S + A230V;
N76D + A228V + A230V;
N218S + R247Q;
N218S + R247H;
N218S + R247E;
N218S + R247K;
D181N + N218S;
N218S + A230V;
K251R + S265K;
P14T + N18K;
T274H + R275H + *275aH + *275bH + *275cH + *275dH;
T274H + R275H + *275aH + *275bH + *275cH;

-continued

S87N + S101G, V104N;
*36D + N76D + H120D + G195E + K235L;
A133P + M222S;
*96aA;
*96aA + A98T;
*96aA + A133P;
*96aA + A98T + A133P;
*96aA + A98T + N218S;
*97aP + A98T + N218S;
*98aT;
*98aT + S99N + N218S;
G97D + *98aT + N218S;
*99aE;
*99aD;
*99aD + M222S;
N76D + s99A + *99aE;
N76D + *99aD + A230V;
S99A + *99aD;
S99A + *99aD + M222S;
S99A + *99aD + N218S;
S99A + *99aE + A230V;
A228V + A230V; or
*130aL + P194A.

2. The detergent composition of claim 1, wherein the hemicellulase is a mannanase, arabinase, galactanase or xylanase.

3. The detergent composition of claim 1, wherein the oxidase is a laccase or peroxidase.

4. The detergent composition of claim 1, wherein the lipase is a lipase from *Humicola* (*Thermomyces*), *Pseudomonas* or *Bacillus*.

5. The detergent composition of claim 1, wherein the lipase is a lipase from *H. lanuginosa* (*T. lanuginosus*), *H. insolens, P. alcaligenes, P. pseudoalcaligenes, P. cepacia, P. stutzeri, P. fluorescens, Pseudomonas* sp. strain SD 705, *P. wisconsinensis, B. subtilis, B. stearothermophilus* or *B. pumilus*.

6. The detergent composition of claim 1, wherein the amylase is an amylase from *Bacillus*.

7. The detergent composition of claim 1, wherein the amylase is an amylase from *B. licheniformis*.

8. The detergent composition of claim 1, wherein the cellulase is a cellulase from *Bacillus, Pseudomonas, Myceliophthora, Humicola, Fusarium, Thielavia* or *Acremonium*.

9. The detergent composition of claim 1, wherein the cellulase is a cellulase from *Humicola insolens, Myceliophthora thermophila* or *Fusarium oxysporum*.

10. The detergent composition of claim 1, wherein the weight ratio of the variant of the subtilisin KL to the at least one other enzyme is from 0.001 to 100.

11. The detergent composition of claim 1, wherein the weight ratio of the variant of the subtilisin KL to the at least one other enzyme is from 0.01 to 10.

12. The detergent composition of claim 1, wherein the weight ratio of the variant of the subtilisin KL to the at least one other enzyme is from 0.5 to 5.

13. The detergent composition of claim 1, wherein the weight ratio of the variant of the subtilisin KL to the at least one other enzyme is from 1 to 3.

14. The detergent composition of claim 1, wherein the content of the variant of subtilisin KL is from 0.001 to 5 weight % and where the content of the at least one other enzyme is from 0.001 to 5 weight %.

15. The detergent composition of claim 1, which is an aqueous liquid or a gel.

* * * * *